US011045684B2

(12) United States Patent
Daly

(10) Patent No.: US 11,045,684 B2
(45) Date of Patent: Jun. 29, 2021

(54) EXERCISE APPARATUS

(71) Applicant: Liam Daly, Reigate (GB)

(72) Inventor: Liam Daly, Reigate (GB)

(73) Assignee: Liam Daly, Weaverville, NC (US)

( * ) Notice: Subject to any disclaimer, the term of this patent is extended or adjusted under 35 U.S.C. 154(b) by 0 days.

(21) Appl. No.: 16/308,946

(22) PCT Filed: Jun. 13, 2017

(86) PCT No.: PCT/GB2017/051718
§ 371 (c)(1),
(2) Date: Dec. 11, 2018

(87) PCT Pub. No.: WO2017/216543
PCT Pub. Date: Dec. 21, 2017

(65) Prior Publication Data

US 2019/0329088 A1 Oct. 31, 2019

(30) Foreign Application Priority Data

Jun. 15, 2016 (GB) ..... 1610415

(51) Int. Cl.
*A63B 23/02* (2006.01)
*A63B 21/00* (2006.01)

(52) U.S. Cl.
CPC ..... *A63B 21/4035* (2015.10); *A63B 23/0211* (2013.01)

(58) Field of Classification Search
CPC ..... A63B 21/072; A63B 21/4035; A63B 21/0004
See application file for complete search history.

(56) References Cited

U.S. PATENT DOCUMENTS

| | | | | | |
|---|---|---|---|---|---|
| D450,361 | S * | 11/2001 | Harms | D21/680 | |
| D508,097 | S * | 8/2005 | Perez | D21/662 | |
| 7,175,576 | B2 * | 2/2007 | Felberg | A63B 21/0004 | 482/139 |
| D551,018 | S * | 9/2007 | Goodman | D21/694 | |
| 7,972,250 | B2 * | 7/2011 | Viselman | A63B 21/072 | 482/141 |
| 8,088,052 | B1 * | 1/2012 | Sprague | A63B 21/0004 | 482/131 |
| 8,702,570 | B1 * | 4/2014 | DelPriore | A63B 71/0036 | 482/51 |
| D712,987 | S * | 9/2014 | Salzedo | D21/662 | |
| D803,956 | S * | 11/2017 | Sutton | D21/680 | |
| D841,746 | S * | 2/2019 | Fazzari | D21/691 | |
| D843,512 | S * | 3/2019 | Petek | D21/682 | |
| 2010/0075819 | A1 * | 3/2010 | Maki | A63B 21/4035 | 482/139 |
| 2016/0129327 | A1 * | 5/2016 | Pinto | A63B 71/14 | 473/438 |

* cited by examiner

*Primary Examiner* — Joshua T Kennedy

(57) ABSTRACT

An exercise device comprising a frame having an outer frame periphery formed of outer longitudinal peripheral members and outer lateral peripheral members, wherein at least two internal handles are formed by at least two internal transverse members extending between the outer longitudinal peripheral members. Preferably there are at least two internal handles which project from the profile of the outer frame and is a centrally positioned aperture suitable for receiving a user's head in use. Preferably the frame is curved along the longitudinal extent. Preferably the frame comprises a deformable coating.

1 Claim, 3 Drawing Sheets

EXERCISE APPARATUS

BACKGROUND OF INVENTION

The present invention relates to an exercise apparatus which can increase the amount or extent of effort required when doing various toning exercises thereby increasing the effectiveness of any such toning exercise.

As a person exercises more frequently, in order to have the same effect or to increase muscle build-up it becomes necessary to either increase the length of time that the person is exercising, or to increase the resistance during the exercise through, for example, the use of weights.

Free weights such as dumbbells or barbells can, when incorporated in exercise regimes, be used to increase muscle strength in a person's legs and arms. However, it is important to try to strengthen all muscles at a similar rate to ensure that there is not an imbalance in the body and to reduce the likelihood of injury. Accordingly, it is also important to exercise the core and abdominal muscles with weights if free weights are being used with other parts of the body. If such exercise is not undertaken then weakness in, for example, the back and stomach area can lead to injury.

Barbells plates can be used to add weight during abdominal exercises but they can be difficult to hold in place, which can lead to slippage and injury. Further, they are uncomfortable when rested on the chest.

As an alternative, sandbags can be used but these are large and unstable, which means that they are difficult to keep in place during exercise and also they can lead to injury if they put more weight on one side or area than another.

U.S. Pat. No. 5,709,634 describes a dumbbell which has been adapted to be held behind a user's head while performing sit-ups. The design has outside handles and in the centre, barbell plates are attached to increase or decrease the weight. The barbell plates are held onto the apparatus by a wing nut and bolt configuration in the centre of apparatus. The protruding wing nut and bolt however result in the user not being able to stably and comfortably return fully to the ground while performing a sit-up.

U.S. Pat. No. 7,261,677 describes a chest plate with handles for use while performing sit-ups. The configuration of this chest plate means that it can only be used in a single position for sit-ups and back extensions, meaning that only certain muscles will be exercised by the weights.

Accordingly, the present invention sets out to address, among other things, the problems described above by providing an exercise apparatus which seeks to alleviate the problems with known methods of weighted exercise of, in particular, the abdominal and core muscles.

SUMMARY OF INVENTION

According to a first aspect of the present invention there is provided an exercise apparatus comprising a frame having a frame periphery formed of outer longitudinal peripheral members and outer lateral peripheral members, wherein at least one internal handle is formed by at least one internal transverse member extending between the outer longitudinal peripheral members.

Preferably, the outer longitudinal peripheral members are longer than the outer lateral peripheral members.

Preferably, the members comprise one or more bars.

The outer longitudinal and lateral peripheral members can be used as outer handles and can be coupled with the provision of one or more internal handles, formed by the internal transverse members, which allows for multiple handle/handhold positions. Accordingly, the exercise apparatus can be used in various positions on the body. For example, both hands can be on the outer lateral peripheral members which provide outer handles to do Russian Twists or one hand can be on an outer lateral or longitudinal peripheral member to do Windmills. In addition, the exercise apparatus can be rested on the user's chest and held in place with cross-arms grasping the opposite outer lateral peripheral members and/or one or more internal handles formed by an internal transverse member. The user can then perform sit-ups or oblique twists. Further, the exercise apparatus can be placed behind the user's head and held in place by grasping the outer lateral peripheral members. The user can then also perform sit-ups or oblique twists.

The elongate frame allows the apparatus to sit across the chest of the user or easily behind their head.

Preferably, at least two outer handles or handhold positions are provided by the outer lateral peripheral members.

Depending upon the number of internal transverse members provided a variable number of handhold positions can be provided, the internal transverse members dividing the external longitudinal members into discrete outer handles. Conveniently between two and ten outer handles or handhold positions are provided. Preferably, between six and ten outer handles or handhold positions are provided.

The internal/outer handles or handhold positions can be profiled to allow the user to easily grip the apparatus or to promote their grip.

Preferably, there are provided at least two internal handles or handhold positions. The internal handles can be arcuate so that they arc out of the general plane of the outer frame or they can be in the same plane as the outer frame.

The availability of a choice of the handles or handhold positions both outer and internal ensures that the user can use the apparatus in various positions thereby allowing a variety of muscles within the body to be exercised.

Preferably the frame is curved along its longitudinal extent. This allows the apparatus to be placed on and slightly around a user's chest or behind a user's head.

Preferably, the frame comprises a deformable material, for example provided on an outer surface of the frame.

Preferably, the deformable material comprises a deformable coating on an outer surface of the frame.

Preferably, the deformable material comprises a foam or rubber material.

Preferably, at least one aperture is formed between an internal transverse member and the outer frame.

Preferably, the frame of the present invention can be provided in different weights. The different weights can be produced by using different types of material, different sizes or different densities of materials.

Conveniently, the cross-sectional shape of the frame is substantially semi-circular, substantially circular, substantially squircle or substantially semi-squircle. The edges of the frame may be arcuate to ensure that it is comfortable when pressed on the body and when being held in the hands. These shapes also ensure that the maximum weight is provided for the size of the apparatus without compromising on the comfort of the user.

Preferably, the at least one internal handle may conveniently be arranged to project from the profile of the outer frame. Unlike the prior art apparatus in U.S. Pat. No. 5,709,634 where the projection is a point, the projection in the present invention will be arcuate which will allow the user to rest upon the apparatus comfortably.

Within this specification, embodiments have been described in a way which enables a clear and concise specification to be written, but it is intended and will be appreciated that embodiments may be variously combined or separated without parting from the invention. For example, it will be appreciated that all preferred features described herein are applicable to all aspects of the invention described herein.

BRIEF DESCRIPTION OF DRAWINGS

An embodiment of the present invention will now be described by way of example and with reference to the accompanying drawings, of which:—

DETAILED DESCRIPTION

Figure 1:
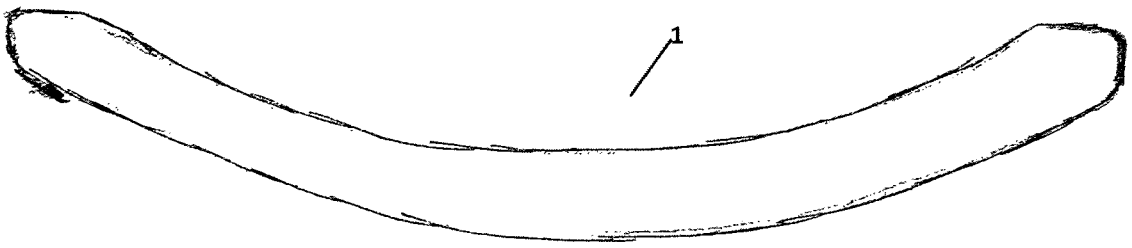
FIG. 1 shows a side view of a first embodiment of the present invention.
Figure 2:
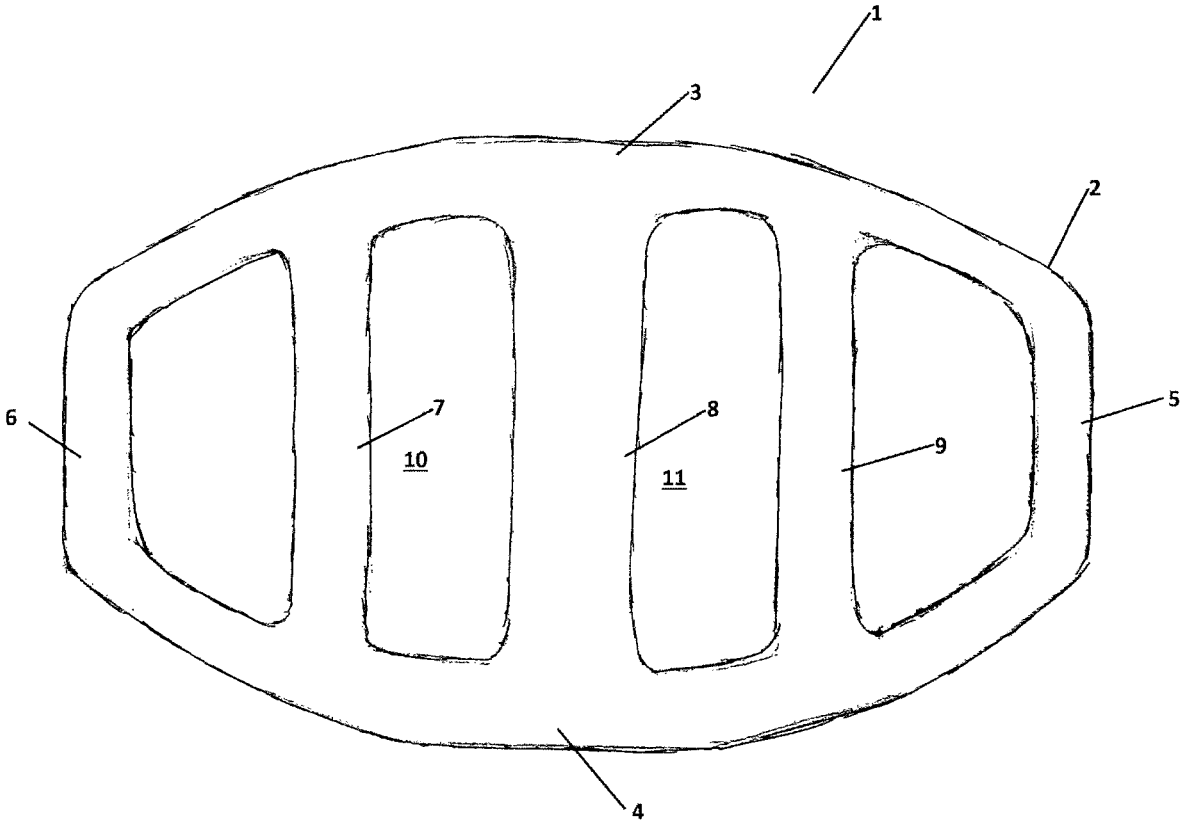
FIG. 2 shows a plan view of the first embodiment of the present invention.

Turning to the Figures, FIGS. 1 and 2 show an exercise apparatus 1 which is a truncated oval shape and has a concave profile. The exercise apparatus 1 has an outer frame 2 which is formed from two longitudinal peripheral members 3 and 4 and two lateral peripheral members 5 and 6. Two outer handles 5 and 6 are provided by lateral peripheral members 5 and 6. Three internal handles 7, 8 and 9 are provided by internal transverse members 7, 8 and 9. The multiple handles allow the exercise apparatus to be held in a variety of positions so that a multitude of exercises can be performed by the user. The exercise apparatus 1 is formed from cast iron; however, it will be appreciated that other suitable materials could be used. It will also be appreciated that the exercise apparatus 1 can be provided with a deformable coating, such as a foam or rubber coating. This provides additional comfort to a user.

Figure 3:
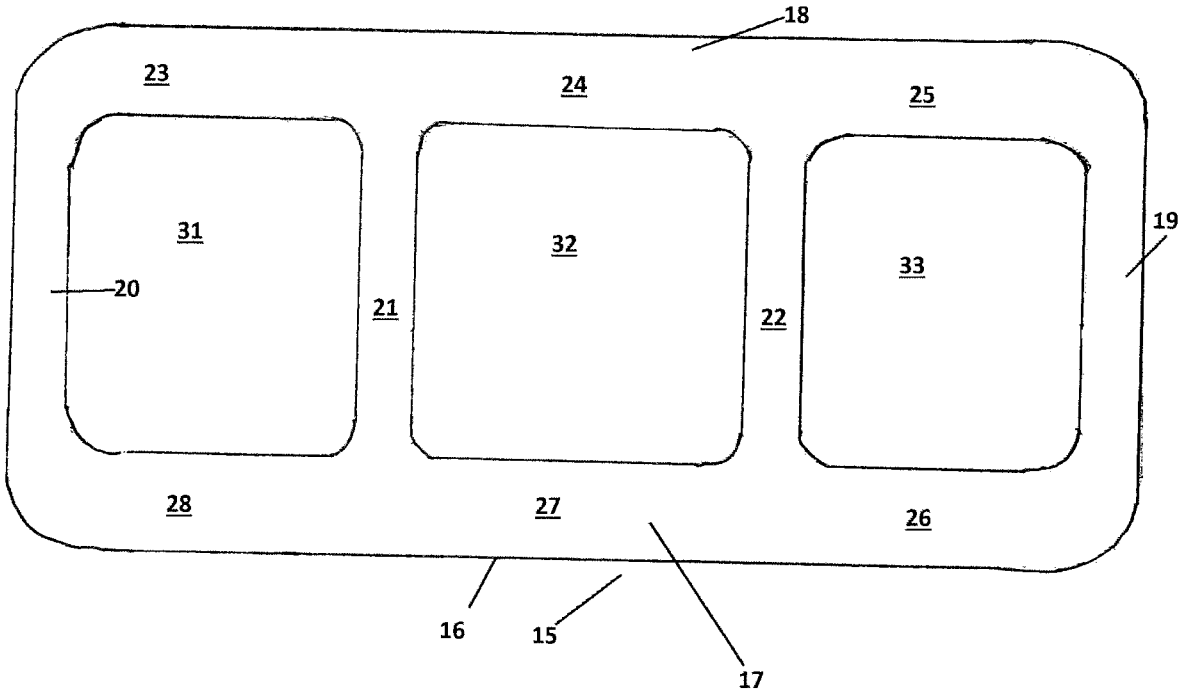
FIG. 3 shows a plan view of the second embodiment of the present invention.
Figure 4:
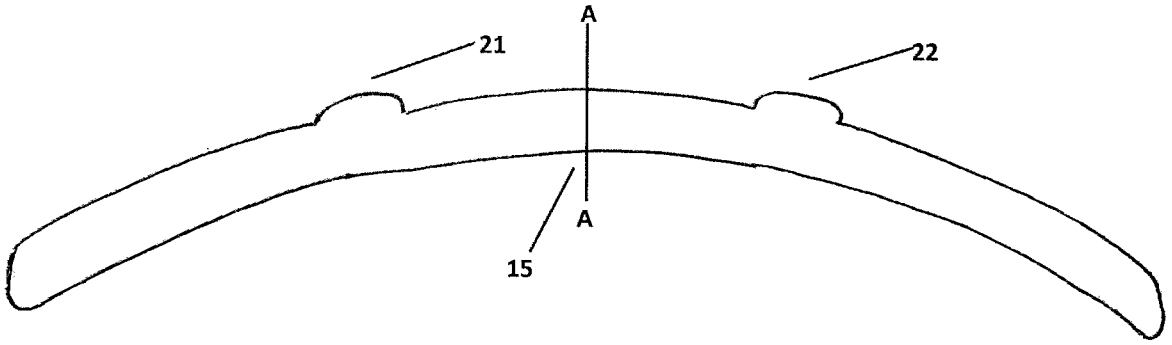
FIG. 4 shows a side view of the second embodiment of the present invention.
Figure 5:
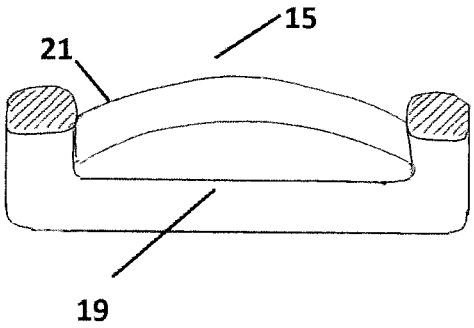
FIG. 5 shows a cross sectional view across line A-A of an embodiment of the present invention as shown in FIGS. 3 and 4.

FIGS. 3, 4 and 5 show a second embodiment of the exercise apparatus. In this embodiment the exercise apparatus 15 is substantially rectangular in shape with rounded corners. The exercise apparatus 15 has a concave profile. The exercise apparatus has an outer frame 16 which is formed from two longitudinal peripheral members 17 and 18 and two lateral peripheral members 19 and 20. Outer handles 19 and 20 are provided by lateral peripheral members 19 and 20. Further outer handles 23, 24, 25, 26, 27 and 28 are provided in the longitudinal peripheral members 17 and 18. Internal handles 21 and 22 provided by internal transverse members 21 and 22.

As can be seen in FIGS. 4 and 5, the internal transverse members 21 and 22 project from the plane of the outer frame. As members 21 and 22 project from the plane of the frame, the user while holding the apparatus behind their head using handles 19 and 20 will not be able to rest their head flat on the floor but due to their equidistant spacing and curved profile the user will be able make contact with the floor in a safe and comfortable manner.

Handles 5, 6, 7, 8, 9, 19, 20, 21, 22, 23, 24, 25, 26, 27 and 28 may be profiled to provide distinct finger slots. Alternatively, the handles can be merely any part of the internal or external member and so the hand, in use, can be placed anywhere comfortable on the member.

FIG. 5 shows a cross-section of the present invention. The cross-sectional shape of the present invention can be any suitable shape, for example, semi-circular, circular, semi-squircle or squircle. However, in FIG. 5 they are squircle.

It should be understood that various changes and modifications to the presently preferred embodiments described herein will be apparent to those skilled in the art. Such changes and modifications can be made without departing from the spirit and scope of the present invention and without diminishing its attendant advantages. It is therefore intended that such changes and modifications are covered by the appended claims.

The invention claimed is:

1. An exercise apparatus, comprising:

a unitary, one-piece rigid frame having an outer frame periphery defined by outer longitudinal peripheral members and outer lateral peripheral members, wherein the outer longitudinal peripheral members are curved along an entire longitudinal extent thereof and define a convex top and a concave bottom surface forming a curved profile;

at least two internal handles are formed by at least two internal transverse members extending between the outer longitudinal peripheral members and defining a centrally positioned aperture configured for receiving a user's head between the internal transverse members, wherein the at least two internal handles are arcuate along a longitudinal extent thereof such that the at least two internal handles project above the convex top surface of the curved profile of the outer longitudinal peripheral members.

* * * * *